United States Patent [19]

Dallas et al.

[11] Patent Number: 5,020,663

[45] Date of Patent: Jun. 4, 1991

[54] COIL DISPENSER FOR COILED NAILS

[76] Inventors: David Dallas, Box 107, Mineral City, Ohio 44656; David R. Watkins, 5906 Louisville St., Louisville, Ohio 44641

[21] Appl. No.: 499,781

[22] Filed: Mar. 27, 1990

[51] Int. Cl.[5] ..... B65D 85/24

[52] U.S. Cl. ..... 206/338; 206/609; 206/613; 224/235

[58] Field of Search ..... 206/338–348, 206/604, 605, 607–615; 224/235

[56] References Cited

U.S. PATENT DOCUMENTS

| | | | |
|---|---|---|---|
| 1,541,532 | 6/1925 | Simmons | 206/612 |
| 2,555,380 | 6/1951 | Stuart et al. | 229/93 |
| 2,867,368 | 1/1959 | Kaplan | 206/614 |
| 3,127,991 | 4/1964 | Burnett | 206/614 |
| 3,315,875 | 4/1967 | Praetorius | 206/615 |
| 4,252,236 | 2/1981 | Roccafort | 206/607 |
| 4,498,581 | 2/1985 | Dutcher | 206/607 |
| 4,712,676 | 12/1987 | Randall | 206/338 |

*Primary Examiner*—Jimmy G. Foster
*Attorney, Agent, or Firm*—Oldham & Oldham Co.

[57] ABSTRACT

A portable cylindrical dispenser having a side casing member with a cutout therein for permitting access to the articles inside the dispenser. The articles are a plurality of like articles, especially coiled nails, which are stacked one on top of the other. The dispenser includes an open top receptacle comprising a generally tubular side casing member and a bottom end closure member inwardly joined thereto, and a top end closure member removably secured to the receptacle for closing the open top. The dispenser may be either a top discharge dispenser, in which case the cutout is long and narrow, extending downwardly from the top but terminating short of the bottom, or a bottom discharge dispenser, in which case the cutout is situated adjacent to the bottom closure member and is wide enough and high enough to permit removal of an article from the dispenser. The cutout may be either a removable part of the side casing member, e.g., a removable strip, joined to the remainder of the casing member along the weakened portion, or an opening. In top discharge dispensers, the cutout is wide enough to permit access but not wide enough to permit removal of an aritcle therethrough, while in the case of a bottom discharge dispenser, the cutout is sufficiently wide to permit both access and discharge of articles. Also disclosed is a package comprising a dispenser as described above having a plurality of like stacked articles, especially rolls of coiled nails, therein.

26 Claims, 3 Drawing Sheets

COIL DISPENSER FOR COILED NAILS

TECHNICAL FIELD

This invention relates to portable dispensers, especially to dispensers for a plurality of stacked articles. More particularly, this invention relates to a dispenser for coiled roofers nails in which the dispenser is constructed and arranged to facilitate removal of the coils of nails, one at a time.

BACKGROUND ART

It is common practice in the roofing industry to drive nails into place by means of a nailer, which is a powered gun-like instrument that drives nails into timbers or shingles. A large number of nails are loaded into a nailer of this type at one time. These nails are usually unitized in the form of a spiral wound roll or coil comprising a plurality of individual nails arranged in parallel fashion and held together by means of a spiral wound tape or a pair of spiral wound thin wires, running transversely to the direction of the nails, and to which the nails are lightly adhered.

The nailer has greatly increased the productivity of roofers, compared to their productivity when nails were driven into place individually with a hammer.

Nails for a nailer are brought to the job site in a nail box, which contains a plurality of rolls or coils of nails, usually stacked one on top of the other and usually with a spacer, such as a plastic sheet or cardboard, between successive coils.

When a roofer needs a coil of nails, he (or she) must climb down from the roof, go to the nail box, which is usually placed on the ground, take a coil of nails, and climb back up on the roof and load the coil into the nailer and resume work. The roofer will customarily load the roll of nails into a pouch, which is typically made of cowhide, to carry the roll from the nail box back to the roof. This arrangement offers two problems: first, the pouch with the roll of nails therein gets in the roofer's way when he leans over, and secondly, the nails may be bent, particularly when the roofer leans over. Bent nails will jam in the nailer, so that the nailer will not function. It is imperative that such bent nails be removed, which is difficult, particularly when the nails in a roll are unitized by means of coiled wires to which the nails are joined by braising.

DISCLOSURE OF THE INVENTION

It is an object of this invention to provide a rigid sturdy dispenser for stacked articles of the same size and shape, which dispenser protects the articles from damage but which permits easy access so that the stacked articles can be removed one at a time.

A more specific object of this invention is to provide a dispenser as described above in which the stacked articles are rolls or coils of nails.

A further object, according to a preferred embodiment of this invention, is to provide a package comprising a disposable dispenser containing a plurality of stacked articles of like size and shape, which dispenser protects the contents from damage and yet permits ready access thereto so that the articles can be removed one at a time.

This invention provides a portable dispenser for a plurality of like articles stacked one on top of the other, which dispenser comprises:

(a) a generally cup-shaped open top container comprising a thin, essentially rigid, upright, generally tubular side casing member having parallel upper and lower edges, and a bottom end closure member integrally joined to said side casing member at the lower edge thereof;

(b) a top end closure member removably secured to said dispenser member, said top end closure and said dispenser member together forming an enclosure for said articles; and (c) a cutout in said side casing member for affording access to said articles, said cutout extending from one of said edges toward the other whereby said other edge forms a closed curve extending around the entire perimeter of the adjacent end closure member, the width of said cutout, as measured along the perimeter of the adjacent closure member, being not more than one-half of said perimeter.

The term "cutout", as used in the specification and claims, includes both a removable solid material (as for example a removable portion of the side casing member) and an opening, in accordance with the definition in "The American Heritage Dictionary", second college edition, 1985, The Houghton Mifflin Company, Boston, page 358. The first definition of "cutout" therein is "[s]omething cut out or intended to be cut out".

BEST MODE FOR CARRYING OUT THE INVENTION

This invention will now be described in detail with reference to specific embodiments thereof.

Figure 1:
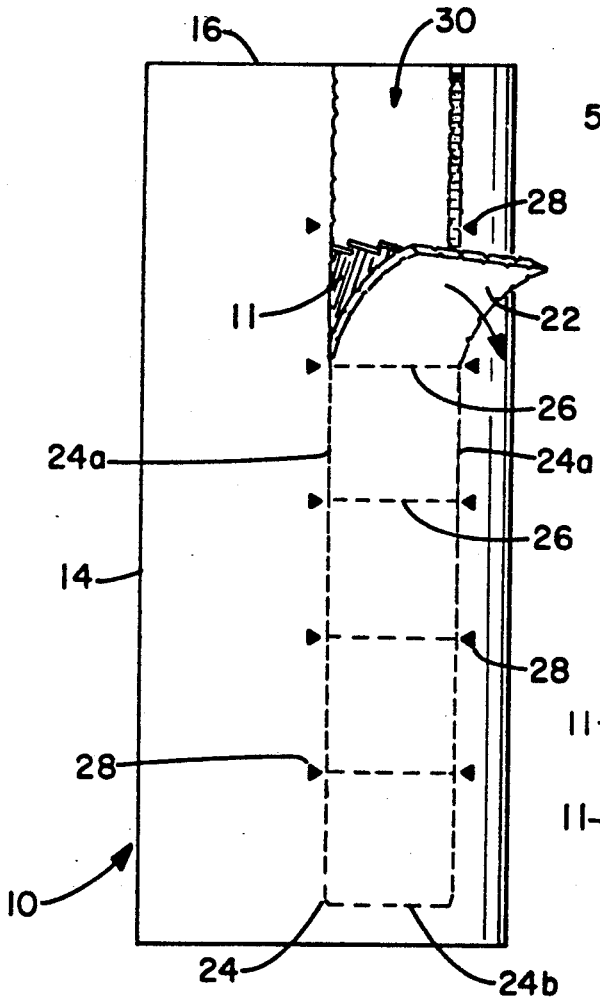
FIG. 1 is an elevational view of a dispenser according to a first embodiment of this invention.

FIGS. 1–4 illustrate a dispenser according to the preferred embodiment of the invention. In FIG. 1, 10 is a top discharge dispenser for a plurality of rolls 11 of coiled nails stacked one on top of the other. Dispenser 10 is in accordance with this invention. Rolls 11 of nails are known in the art, and are typically essentially cylindrical in shape with a cylindrical hole in the center, and either one inch or 1-½ inch in diameter.

Dispenser 10 comprises a generally cup-shaped open top container 12 which in turn comprises a thin, essentially rigid upright generally tubular side casing member 14 which has parallel upper and lower edges 16 and 17, respectively, and a bottom end closure member 18. Bottom end closure member 18 is integrally joined to side casing member 14 by any desired means, e.g., by to side casing member 14 by any desired means, e.g., by gluing. Bottom end closure member 18 is typically in the form of a thin flat disk, but may include a rim at its edge to facilitate joinder to side casing member 14.

Dispenser 10 further comprises a top end closure member 20, which is removably secured to container 12 by any desired means, such as adhesive strip 21, which has an adhesive coating on its underside. Top closure member 20 is shown in this embodiment as a thin flat disk which rests on its top edge 16 of side casing member 14. Details of the top closure member structure and the manner in which it is removably affixed to container 12 may vary. The open top of container 12, with the top end closure member 20 removed, forms the discharge opening.

Side casing member 14 has a vertically extending cutout 22, which in this embodiment is a removable portion of the side casing member, for affording access to the articles (i.e., rolls 11 of coiled nails) contained in dispenser 10. Cutout 22, which prior to being torn away, is integrally joined to side casing 14 by means of a weakened portion 24, here shown as dash line perforations. Weakened portion 24 is three-sided, consisting of two vertical (and therefore parallel) line segments **24*a* joined by a horizontal line segment 24*b*, which is parallel to and just a short distance above lower edge 17 of side casing member 14. (This distance is less than the height of one roll 11). Cutout 22 is long and narrow, and essentially rectangular in shape, and extends downwardly from top edge 16 toward bottom edge 17 of side casing member 14 but terminating short of the bottom edge. The height of cutout 22 must be sufficient to afford access to each roll 11 of nails in turn. Thus, the height of cutout 22 is just slightly less than the height of side casing member 14, the height of which is the distance between parallel edges 16 and 17. The width of cutout 22 is typically from about three-quarters inch (approximately 2 cm.) to approximately one and one-half inch (approximately 4 cm.), which is from about the width of an adult's index finger to somewhat wider than the width of an adult's index finger. Cutout 22 may be peeled away, as shown in FIG. 1, as the user wishes to gain access to the interior of dispenser 10 in order to remove a coil of nails therefrom. Cutout 22 may be provided with a series of horizontal perforations 26, which are spaced apart by a distance equal to the height of an individual article (e.g., roll of nails) contained in dispenser 10, so that the user need only peel away as much of cutout 22 as is necessary to reach the next roll of nails remaining in the dispenser. The casing 16 may contain a series of markers 28 positioned alongside perforations 26, to mark their location and to make it easier for the user to see at a glance how much of cutout 22 to peel away. As cutout 22 is peeled away, a vertically extending access opening 30, which permits the user to stake his or her finger into the interior of dispenser 10 in order to grasp and lift a roll 11** of nails therein.

The dispenser 10, including top and bottom closure members 20 and 18 respectively, side casing member 14, and cutout 22, are all preferably made of cardboard and particularly corrugated cardboard. Other suitable materials include essentially rigid thermoplastics (e.g., rigid polyvinyl chloride and high impact polystyrene) in thin sheet form. Bottom closure member 14 must be made of a material which is sufficiently strong to support the weight of the articles contained in dispenser 10. The side casing member 14 should be sufficiently strong and rigid as to protect the contents of dispenser 10, particularly from forces exerted in a frontal direction (e.g., perpendicular to the surface of the side casing member 14). At the same time, the casing material should be sufficiently deformable (i.e., capable of bending) so that the cutout 22 can be torn away along perforations 24.. The term, "essentially rigid", includes preferred materials of this sort as well as materials of greater rigidity so that they cannot be bent without breaking.

Handle 34 is provided on the exterior of dispenser 10, so that a workman may attach the dispenser 10 to his or her belt (or other article of clothing, such as a trouser waistband) for ease in carrying. Handle 34 is located diametrically opposite cutout 22.

Figure 2:
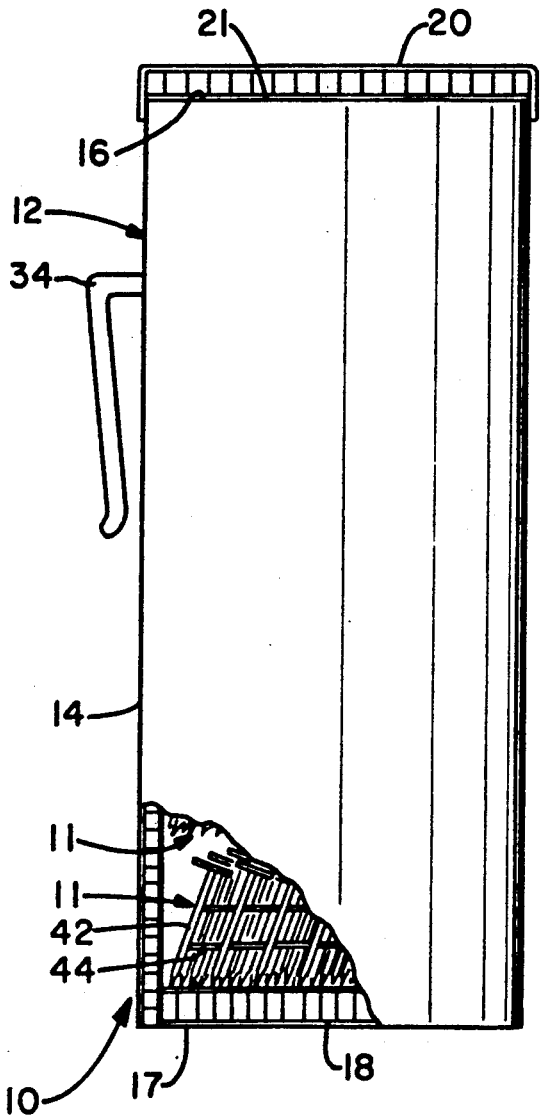
FIG. 2 is a side elevational view of the dispenser shown in FIG. 1, with parts cut away and parts shown in section.

The preferred contents of dispenser 10 are a plurality of rolls 11 of nails, stacked one on top of the other as may be seen best in FIG. 2. All the rolls 11 of nails are alike. Each roll 11 of nails comprises a plurality of nails 42, set in parallel fashion at a steeply inclined angle (i.e., at a small angle to the vertical). The nails are joined together and unitized by a pair of horizontally extending thin metal bands 44, to which the individual nails 42 are lightly joined as for example by brazing. The bands 44 and nails adhering thereto are spiral wound. A roll 11 of nails is essentially toroidal in shape. The outside outline is in the shape of a right circular cylinder having a diameter just slightly less than the inside diameter of casing member 14. The inside outline (between the nails and the hole in the center) is also essentially cylindrical but of smaller diameter than the outside outline.

Dispenser 10 and a plurality of rolls 11 of nails therein, one stacked on top of the other, together form a package according to this invention. Dispenser 10 is disposable. It is intended for a single use and may be discarded after the last roll 11 of nails has been removed.

The user opens dispenser 10 by removing (and usually discarding) top end closure member 20. He or she then peels away the upper portion of cutout 22 along vertical perforation lines 24 until the uppermost horizontal perforation line 26 is reached. The user then reaches in through the vertical solid opening 30 thus formed and removes the uppermost roll 11 of coils through the open top. When the next roll 11 of nails is required, the user peels away the cutout 22 further, i.e., to the second horizontal perforated line, and removes the second roll 11 of nails. This process is repeated until cutout 22 has been peeled away to its bottom extremity and the last roll of nails 11 has been removed.

Figure 4:
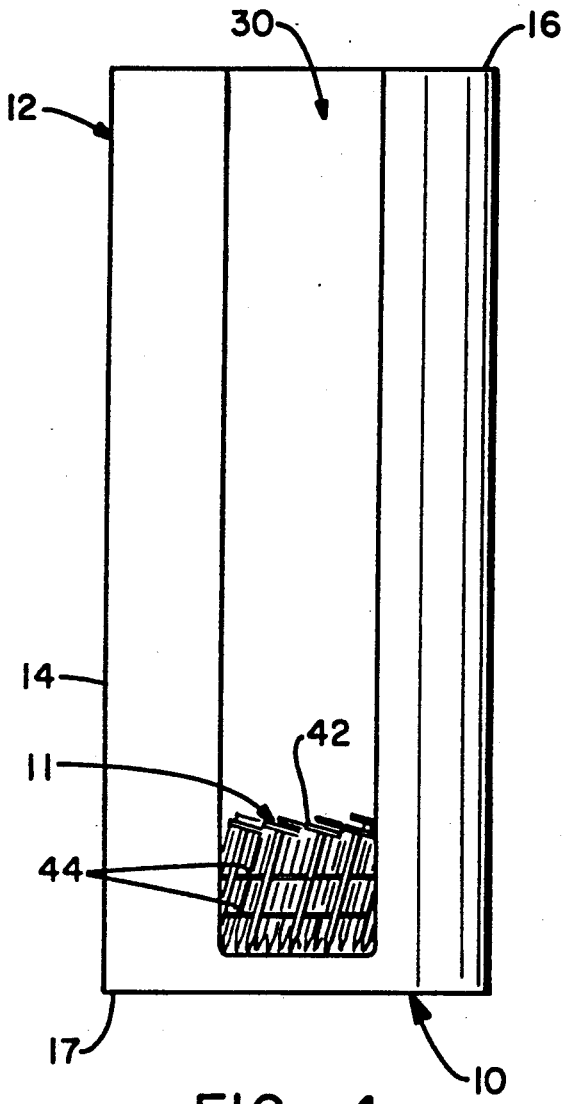
FIG. 4 is a front elevational view of the dispenser shown in FIG. 1, with the cutout completely removed.

FIG. 4 illustrates a dispenser 10 according to this invention in which cutout 22 has been entirely peeled away, leaving a vertically extending opening 30 extending almost the entire height of side casing member 14, and containing only one roll 11 of nails.

Figure 5:
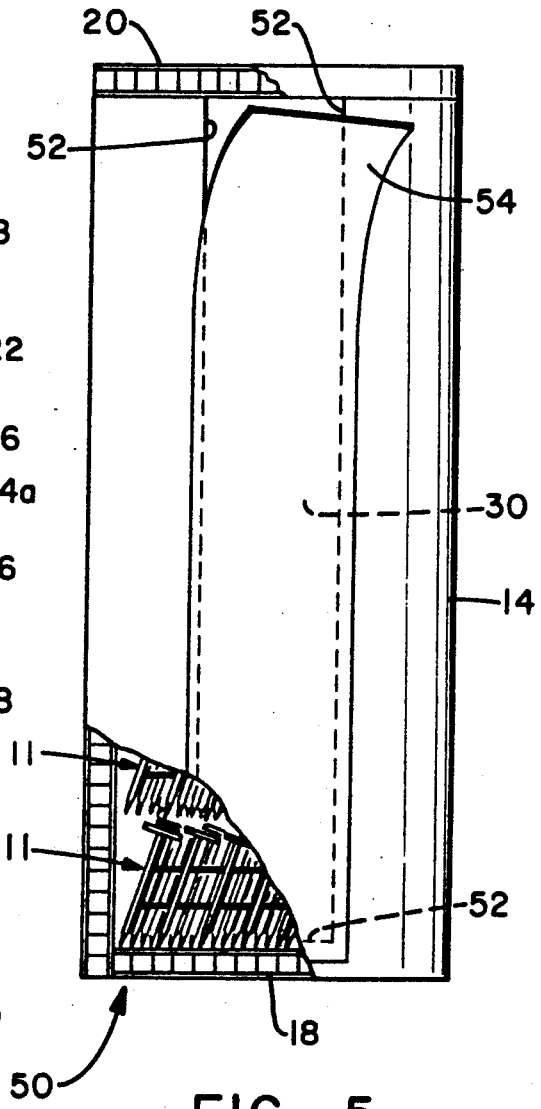
FIG. 5 is a front elevational view of a dispenser according to a second embodiment of this invention.
Figure 3:
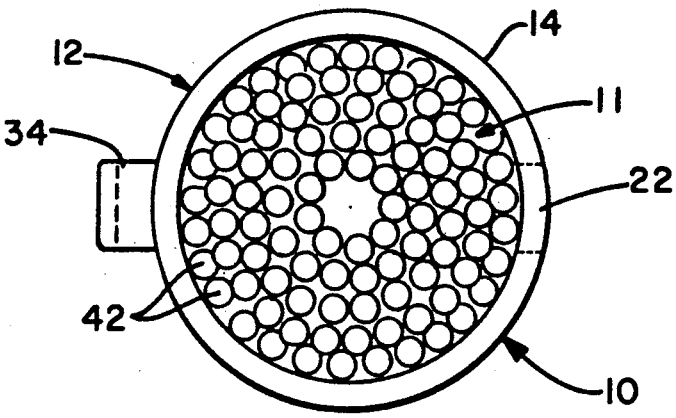
FIG. 3 is a top view of the dispenser shown in FIG. 1 with the top closure member removed.

The second embodiment of this invention is similar to the first, except that a vertically extending opening 30 (which is another form of cutout) replaces the vertically extending removable cutout 22 shown in FIG. 1. The second embodiment is shown in FIG. 5. Referring now to FIG. 5, dispenser 50 according to this embodiment comprises side casing member 14, bottom end wall 18, and top end wall 20, which may be substantially as shown in FIGS. 1–4. Materials, configurations and dimensions are preferably the same in both embodiments. A three sided edge 52, consisting of two vertical (and parallel) straight line segments joined by a horizontal segment, forms the boundary between side casing member 14 and opening 30. Edge 52 may have the same dimensions and configuration as those of weakened portion 24 in FIG. 1. A thin flexible strip 54 of adhesive tape, which has an adhesive coating (not shown) on the inside surface thereof, may be provided as shown in FIG. 5 to cover the opening 30 during shipment. This adhesive tape strip 54 is adhered to side casing member 14 near edge 52. Once this strip 54 of adhesive tape has been peeled away, the dispenser according to this second embodiment looks almost exactly like the dispenser 10 of the first embodiment after the removable cutout 22 has been completely removed, as shown in FIG. 3.

A dispenser 50 according to this second embodiment of the invention may be either disposable or reusable. The dispenser 50 actually shown in FIG. 5 has top end closure member 20, bottom end closure member 18 and side casing member 14 made of corrugated cardboard, and is disposable. However, a reusable dispenser made of either sheet metal or rigid plastic sheet of thickness too great for bending may be formed according to this second embodiment. In that case, the bottom closure member 18 may be permanently joined to the side casing member 14 by conventional means used in forming metal or rigid plastic dispensers. Top closure member 20 may be in the form of a conventional lid having a flat circular surface and a downturned rim or lip which overlies the top edge 16 of side casing member 14.

It will be noted that, in both the first and second embodiments described above, side casing member 14 and the cutout (removable cutout 22 in FIG. 1, opening 30 in FIG. 5) together form the entire side surface of a right circular cylinder and encompass the entire perimeter of both the top and bottom ends of the cylinder. The top edge 16 is arcuate and extends around at least 50% of the perimeter of the top end (i.e., at least 180° in the case of a right circular cylinder) and preferably most of the circumference, i.e., about 270° to about 330°. Bottom edge 17 is circular and extends around the entire perimeter or circumference of the bottom end of the cylinder.

Figures 6, 7:
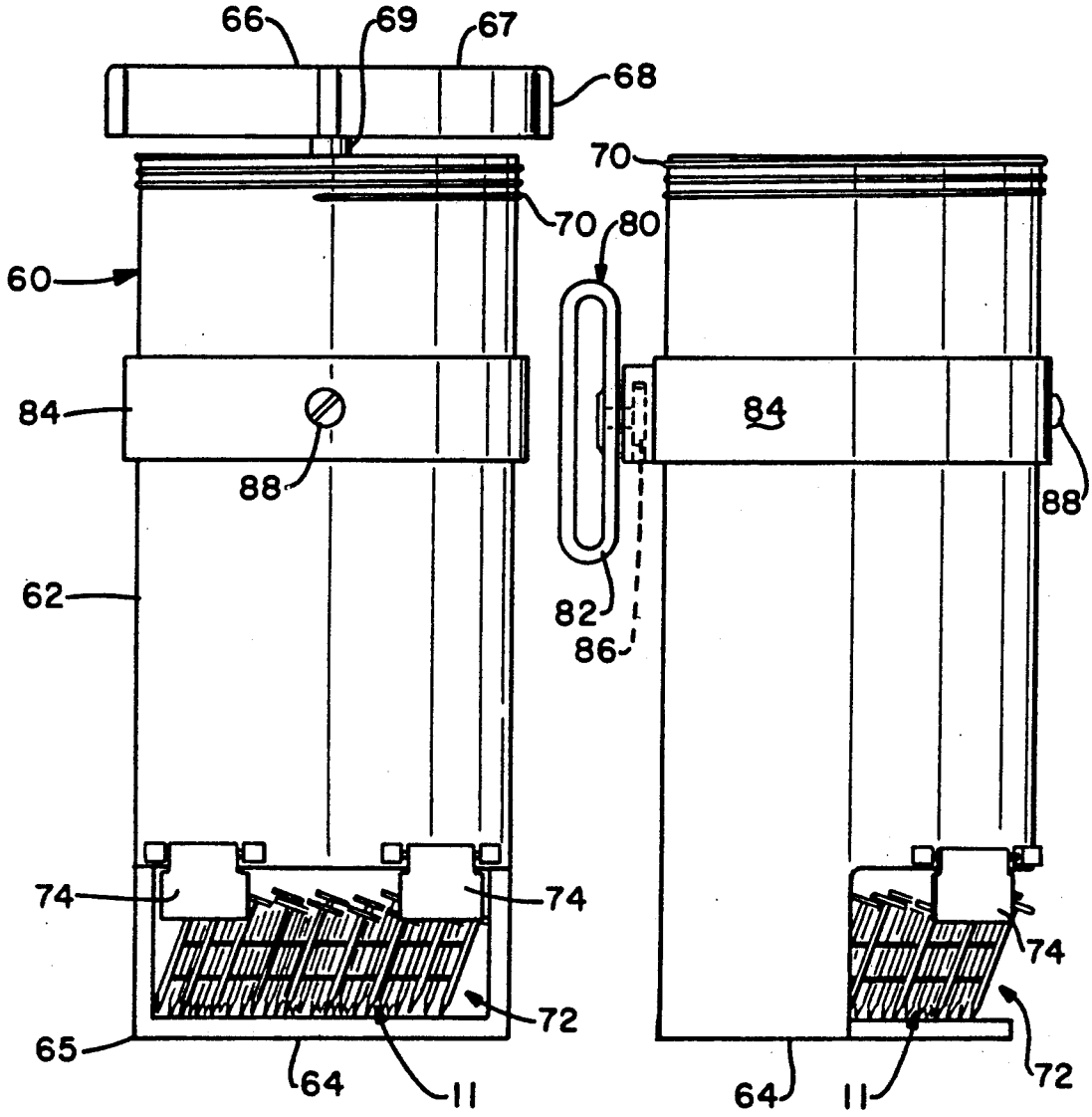
FIG. 6 is a front elevational view of a dispenser according to a third embodiment of this invention.
FIG. 7 is a side elevational view of the dispenser shown in FIG. 6.

This invention will now be described in further detail with reference to a third embodiment thereof, as shown in FIGS. 6 and 7.

Referring now to FIGS. 6 and 7, 60 is a bottom discharge dispenser having a cylindrical side casing member 62 and a flat circular bottom end closure member 64 which are integrally joined together to form an open top container 65 which is essentially in the shape of a right circular cylinder.

Inside dispenser 60 are a plurality of rolls 11 of nails, similar to those shown in previously described embodiments, stacked one on top of the other.

A removable top end closure member 66 closes the open top of container 65. Top closure member 66 has a flat top surface 67 and a downturned rim 68, which may be internally screw threaded, and an axially downwardly extending rod 69. Then, rod 69, preferably made of aluminum, extends downwardly from top 62 along the center axis of the dispenser 60. This rod 69 serves as a spindle and aids in loading coils into the dispenser 60 and in restraining undesired lateral movement. Rod 69 extends through the center hole of each roll 11 except the lowermost when lid 66 is affixed to dispenser 65. The top portion of side casing member 62 may be externally screw threaded, at 70, to receive the internal screw threads of the top 66.

Lid 66 and bottom 64 form the top and bottom ends respectively, of a right circular cylinder. Side casing member 62 encompasses most of the side surface of the cylinder.

Side casing member 62, bottom end closure member 64 and top end closure member 66 are all preferably formed of sheet metal (usually either steel or aluminum) but may be formed of rigid plastic if desired. The side casing member 62 of this embodiment, unlike the side casing member 14 of the embodiment of FIGS. 1–4, does not have to be flexible enough to permit bending by hand, and in fact such flexibility is not preferred.

A portion of the side casing member 66 is cut away to form an opening or a cutout 72. This opening or cutout 72 is adjacent to the bottom closure member 64 and the lower edge of side casing member 62. This opening 64 serves both as an access opening and as a bottom discharge opening for articles inside dispenser 60. The opening 72 must be wide enough and high enough to permit a roll 11 of nails to be removed therethrough. Thus, opening 72 must extend around one-half or nearly one-half the circumference of bottom closure member 64. The height of opening 72 is preferably just slightly greater than the height of one roll 11 of nails. Opening 72 extends upwardly from the bottom closure member 64 (and hence also from the lower edge of side casing member 62) toward (but not to) the top closure member 66 and the top edge of side casing member 62. The height of opening 72 is in all cases not substantially more than one-half the height of side casing member 66. Since a height only slightly greater than that of one roll 11 of nails is required, the height of opening 72 will be more than one-half the height of side casing member 62 only when the height of the dispenser is such as to contain only two rolls of nails. In most cases there are more than two rolls, and therefore the height of opening 72 is substantially less than one-half the total dispenser height.

A pair of swinging flaps 74, spring loaded and mounted on hinges immediately above opening 72, prevent or restrain undesired discharge of a roll 40 from dispenser 60.

Since rod 69 terminates above the top edge of opening 72 and above the top of the lowermost roll 11 of nails in dispenser 60, rod 69 does not prevent discharge of a roll 11 through discharge opening 72.

Means 80 are provided for mounting the dispenser 60 on the belt of a user. These means comprise an oblong metallic loop 82 through which a belt may extend, an adjustable collar 84 which extends around the circumference of dispenser 60 and on which loop 82 is mounted by means of a swivel mounting 86. A set screw 88 is provided for holding collar 84 and hence the entire belt mounting assembly 80 in place.

To load a plurality of rolls 11 of nails into dispenser 60, one removes the top closure member 66, inverts it, and places the desired number of rolls onto rod 69, which serves as a spindle. One then places the rolls 11 of nails inside the dispenser 60 and screws down the top 66.

Rolls 11 of nails are removed from dispenser 60 one at a time through opening 72. When the user wishes to remove a roll of nails, he or she pushes the spring biased flap 74 inwardly against the bias of the springs and removes one roll 11 of nails. The flaps return to their normal vertical position when the user's hand or fingers are removed. The next roll 11 of nails pulls by gravity into place at the bottom of the dispenser 60, and so on, until the last roll 11 has been removed.

A dispenser (e.g., 10, 50 or 60) according to this invention is in the shape of a geometric figure having two ends which are planar, parallel, and of the same size and shape, and a side which is the surface joining the perimeters of the tWo ends. In particular, a dispenser according to this invention is cylindrical. Preferably, the dispenser is in the shape of a right circular cylinder.

The cross-sectional shape of the dispenser does not have to be circular, although it preferably is, as shown in all embodiments herein specifically illustrated. The cross-sectional shape can be elliptical, oval, or polygonal, e.g., rectangular, square, hexagonal or octagonal. With the exception of the rectangle, the preferred polygonal cross-sectional shapes are those of regular polygons. The term, "side", in the context of a geometric figure of polygonal cross-section, refers to the entire surface joining the two ends and not merely to one planar face thereof.

The preferred geometric figures are those in which the side is perpendicular to the two ends, as shown in all embodiments specifically illustrated herein. However, the side may be inclined at a small angle (up to approximately 30°) from the perpendicular.

While the invention has been specifically illustrated with respect to dispensers for rolls or coils of nails stacked one on top of the other, dispensers for other stacked articles may be constructed in accordance with this invention. Thus, the articles stacked one on top of the other inside a dispenser of this invention may be cookies, crackers, paper plates, or virtually any article which is amenable to packaging of a plurality of like articles stacked one above the other.

The size and shape of the cutout (22, 30 or 72) is such as to afford access to each article in turn without tipping the dispenser (10, 50 or 60) from an upright position. In the case of a top discharge dispenser (e.g., 10 or 50), the cutout is long and narrow, so that it will no serve as a discharge opening. The cutout in this case extends downwardly from the top edge but usually terminates short of the lower edge. The cutout can extend from the upper to the lower edge when necessary or convenient, e.g., when the articles are thin (e.g., paper plates). In the case of a bottom discharge dispenser (e.g., 60), the cutout (e.g., 72) serves both as access opening and discharge opening and must be dimensional accordingly. The height of the cutout in this case should be insufficient to permit more than one article at a time. The height should therefore be equal to or greater than the height of the article, but less than twice the height of the article.

The dispenser may be either disposable or reusable. The first embodiment in FIGS. 1–4 is particularly suited to disposable dispensers. A disposable dispenser must be made of a material which is stiff enough to hold its shape and strong enough to protect the articles inside from damage. However, the disposable dispenser material preferably has a degree of flexibility so that it can be bent or "peeled" to remove a cutout (e.g., 22). Cardboard, especially corrugated cardboard, is preferred; certain sheet plastics, such as high impact polystyrene, of thin enough gauge to permit bending by hand, can also be used. A dispenser according to the second embodiment (FIG. 5) may be either disposable or reusable. Materials for reusable dispensers are preferably rigid, e.g. steel or rigid polyvinyl chloride (PVC) of sufficient thickness to preclude bending by hand. Dispensers according to the third embodiment may be either disposable or reusable, although in general this embodiment lends itself best to reusable dispensers.

A dispenser according to this invention may be made in any convenient size, in accordance with the number and size of the articles to be contained. The inside diameter of the dispenser is ordinarily just slightly larger than the outside diameter of the articles to be contained. A standard outside diameter for rolls 11 of coiled nails as illustrated herein is 1-½ inches. The inside diameter of the dispenser should therefore be just slightly larger than 1-½ inches. Similarly, a dispenser for one inch diameter rolls of coiled nails (another standard size) may be just slightly larger than one inch in diameter. A standard roll of coiled nails is toroidal or doughnut-shaped, with a hole in the center, which permits such rolls to be placed on a spindle as illustrated in FIG. 6 and 7 herein. The height of the dispenser is such as to contain a desired number of articles. For example, in the case of rolls of coiled nails, the dispenser will usually be made for either 4, 6 or 8 such rolls.

A dispenser according to this invention affords several advantages to the user. First, a dispenser according to this invention, being small and portable, may be carried to the point of actual use, such as a roof or a scaffold alongside a vertical wall. Second, a dispenser according to this invention is stiff enough and strong enough to protect the nails inside from deformation. This is not the case with the presently used cowhide pouches. Third, a dispenser according to this invention is small enough so that it does not interfere with the bending movements of the user as he or she works. Other advantages will be apparent to those skilled in the art.

While this invention has been described in detail with reference to specific embodiments thereof, it shall be understood that these are described by way of illustration and not by way of limitation.

What is claimed is:

1. A portable dispenser for a plurality of like articles stacked one on top of the other, said dispenser comprising:

(a) a generally cup-shaped open top container comprising a thin, essentially rigid, upright, generally tubular side casing member having parallel upper and lower edges, and a bottom end closure member integrally joined to said side casing member at the lower edge thereof;

(b) a top end closure member removably secured to said dispenser member, said top end closure and said dispenser member together forming an enclosure for said articles;

(c) a cutout in said side casing member for affording access to said articles, said cutout extending from one of said edges toward the other whereby said other edge forms a closed curve extending around the entire perimeter of the adjacent end closure member, the width of said cutout, as measured along the perimeter of the adjacent closure member, being not more than one-half of said perimeter; and (d) means on the exterior of said container for affixing said dispenser to an article of clothing of a user.

2. A dispenser according to claim 1, said dispenser being in the shape of a right circular cylinder.

3. A dispenser according to claim 1 wherein said articles are rolls of coiled nails.

4. A dispenser according to claim 1, said dispenser being a top discharge dispenser wherein said cutout is elongated in the vertical direction and extends downwardly from the upper edge of said side casing member toward the lower edge thereof, the height being sufficient to permit access to each article in turn and the width being insufficient to permit removal an article through said cutout.

5. A dispenser according to claim 4 in which said cutout terminates short of the lower edge.

6. A dispenser according to claim 4 in which said cut-out is in the form of a long, narrow vertically extending slotted opening.

7. A dispenser according to claim 6, said dispenser including removable flexible means for covering said opening.

8. A dispenser according to claim 7 wherein said removable flexible means is an adhesive tape having a width slightly greater than that of said slotted opening, the edges of said adhesive tape being adhered to said side casing member on either side of said opening.

9. A dispenser according to claim 1 wherein said cutout is a removable portion of said side casing member which is joined to the remaining portion through a weakened portion.

10. A dispenser according to claim 9 wherein said weakened portion is formed by perforations in said side casing member.

11. A dispenser according to claim 9 wherein said weakened portion is of essentially three sided configuration comprising two vertical line segments extending downwardly from said top edge and a horizontal line segment joining said two vertical line segments.

12. A dispenser according to claim 9 wherein said side casing member is made of a materil having sufficient flexibility to permit removal of said cutout by tearing along said weakened portion.

13. A dispenser according to claim 12 wherein said side casing member is made of cardboard.

14. A dispenser according to claim 13 wherein said cardboard is corrugated cardboard 15. A dispenser according to claim 1, said dispenser being a bottom discharge dispenser wherein said cutout extends upwardly from the lower edge of said side casing member and the width and height of said cutout are sufficient to permit the removal of an article therethrough.

16. A dispenser according to claim 15 wherein the height of said cutout is equal to or slightly greater than the height of one of said articles.

17. A dispenser according to claim 15, further including spring biased flaps mounted on said side casing member adjacent to said cutout for preventing inadvertent removal of an article from said dispenser.

18. A package according to claim 1 wherein said dispenser is in the shape of a right circular cylinder.

19. A package according to claim 18 said package being disposable.

20. A package according to claim 19 wherein said side casing member is made of cardboard.

21. A package according to claim 20 wherein said side casing member has a weakened portion separating said cutout from the remaining portion of said side casing member, said remaining portion being the major portion.

22. A package according to claim 1 wherein said dispenser is a top discharge dispenser and said cutout extends vertically downwardly from the upper edge of the side casing member and terminates short of the lower edge.

23. A package comprising:

(a) A portable dispenser for a plurality of like coils of nails stacked one on top of the other, said dispenser comprising:

(1) a generally cup-shaped open top container comprising a thin, essentially rigid, upright, generally tubular side casing member having parallel upper and lower edges, and a bottom end closure member integrally joined to said side casing member at the lower edge thereof;

(2) a top end closure member removably secured to said dispenser member, said top end closure and said dispenser member together forming an enclosure for said articles; and (3) a cutout in said side casing member for affording access to said articles, said cutout extending from one of said edges toward the other whereby said other edge forms a closed curve extending around the entire perimeter of the adjacent end closure member, the width of said cutout, as measured along the perimeter of the adjacent closure member, being not more than one-half of said perimeter; and (b) a plurality of coils of nails of like size and shape contained therein and stacked one on top of the other, each coil comprising a plurality of nails oriented in the same direction and spiral wound unitizing means adhered to each of said nails and extending in a direction transverse to that of the nails.

24. A package according to claim 23 wherein said dispenser is in the shape of a right circular cylinder and is a top discharge dispenser wherein said cutout is elongated in the vertical direction and extends downwardly from the upper edge of said side casing member toward the lower edge thereof but terminates short of said lower edge, the height being sufficient to permit access to each coil of nails in turn and the width being insufficient to permit removal of a coil of nails through said cutout.

25. A disposable package comprising:

(a) a portable dispenser for a plurality of like articles stacked one on top of the other, said dispenser being in the shape of a right circular cylinder and comprising:

(1) a generally cup shaped open top container comprising a thin, essentially rigid, upright, generally tubular cardboard side casing member having parallel upper and lower edges, and a bottom end closure member integrally joined to said side casing member at the lower edge thereof;

(2) a top end closure member removably secured to said dispenser member, said top end closure member and said dispenser member together forming an enclosure for said articles;

(3) a cutout in said side casing member for affording access to said articles, said cutout extending from one of said edges toward the other whereby said other edge forms a closed curve extending around the entire perimeter of the adjacent enclosure member, the width of said cutout, as measured along the perimeter of the adjacent closure member, being not more than one half of said perimeter, and (4) a handle affixed to the exterior of said dispenser, said handle and said cutout being diametrically opposite to each other; and (b) a plurality of articles of like size and shape contained therein.

26. A package according to claim 2 wherein said articles are rolls of coiled nails.

* * * * *